United States Patent [19]

Gamundi

[11] 4,372,426

[45] Feb. 8, 1983

[54] MAST STRUCTURE

[75] Inventor: Reynold F. Gamundi, Bountiful, Utah

[73] Assignee: Eaton Corporation, Cleveland, Ohio

[21] Appl. No.: 350,703

[22] Filed: Feb. 22, 1982

Related U.S. Application Data

[63] Continuation of Ser. No. 106,077, Dec. 20, 1979, abandoned.

[51] Int. Cl.[3] ..... B66B 9/00

[52] U.S. Cl. ..... 187/1 R; 182/63; 248/188.4

[58] Field of Search ..... 187/9 R, 9 E, 1 R; 29/464, 469; 414/629, 631; 248/188.2, 188.4, 650, 651; 182/68, 69, 63; 403/388

[56] References Cited

U.S. PATENT DOCUMENTS 1,214,774 2/1917 Grant ..... 182/68

3,813,735 6/1974 Thiermann ..... 403/388

*Primary Examiner*—Stanley H. Tollberg

*Assistant Examiner*—Kenneth Noland

*Attorney, Agent, or Firm*—C. H. Grace; F. M. Sajovec

[57] ABSTRACT

A mast structure (28) for a storage/retrieval machine (10) wherein the mast is pivotally supported on a support structure (30) and temporarily secured by bolts (54) acting on the support structure and the mast, and the mast is moved above its pivot (52) by adjusting devices (56, 58, 64) mounted on the support structure and mast to obtain precise vertical alignment of the mast as determined by a plumb line or other known adjusting devices. In accordance with another aspect of the invention, adjustable connectors (78, 80, 82) are provided to join two previously aligned masts to define a double masted storage/retrieval machine.

6 Claims, 5 Drawing Figures

28
10
26
22
24
20
14
30
16
12
18

MAST STRUCTURE

This is a continuation, of application Ser. No. 106,077, filed Dec. 20, 1979, now abandoned.

The present invention relates to storage/retrieval machines, and more particularly to a method and apparatus for vertically aligning the mast of a storage/retrieval machine.

The mast of a storage/retrieval or S/R machine can be seventy feet long or longer. When the machine is erected on a job site, it is critical that the mast be properly aligned vertically in order for the machine to function properly in relation to the storage rack structures with which it interfaces.

The prior art method for aligning an S/R machine involves the use of shims placed under the base of the machine, a trial and error process which can involve the lifting of a 20,000 lb. to 30,000 lb. machine numerous times. It can be appreciated that such handling of a machine is time consuming and expensive.

What the present invention provides is a mast structure for an S/R machine and a method for aligning such structure wherein the mast structure is pivotally supportable in a receiving structure mounted on a base, such that when the mast is erected on a job site it is placed on its pivotal support and temporarily secured, whereupon the mast is precisely aligned by a known optical or mechanical alignment method using adjustable means acting between the receiving structure and the mast to move the mast about its pivot. The mast is then permanently attached to its receiving structure on the base. In accordance with another aspect of the invention means are provided for aligning the masts of a double masted S/R machine which includes aligning each mast separately as above, after which the separate mast structures are tied together.

Other objects and advantages of the present invention will be apparent from the following description when considered in connection with the accompanying drawings, wherein.

Figure 1:
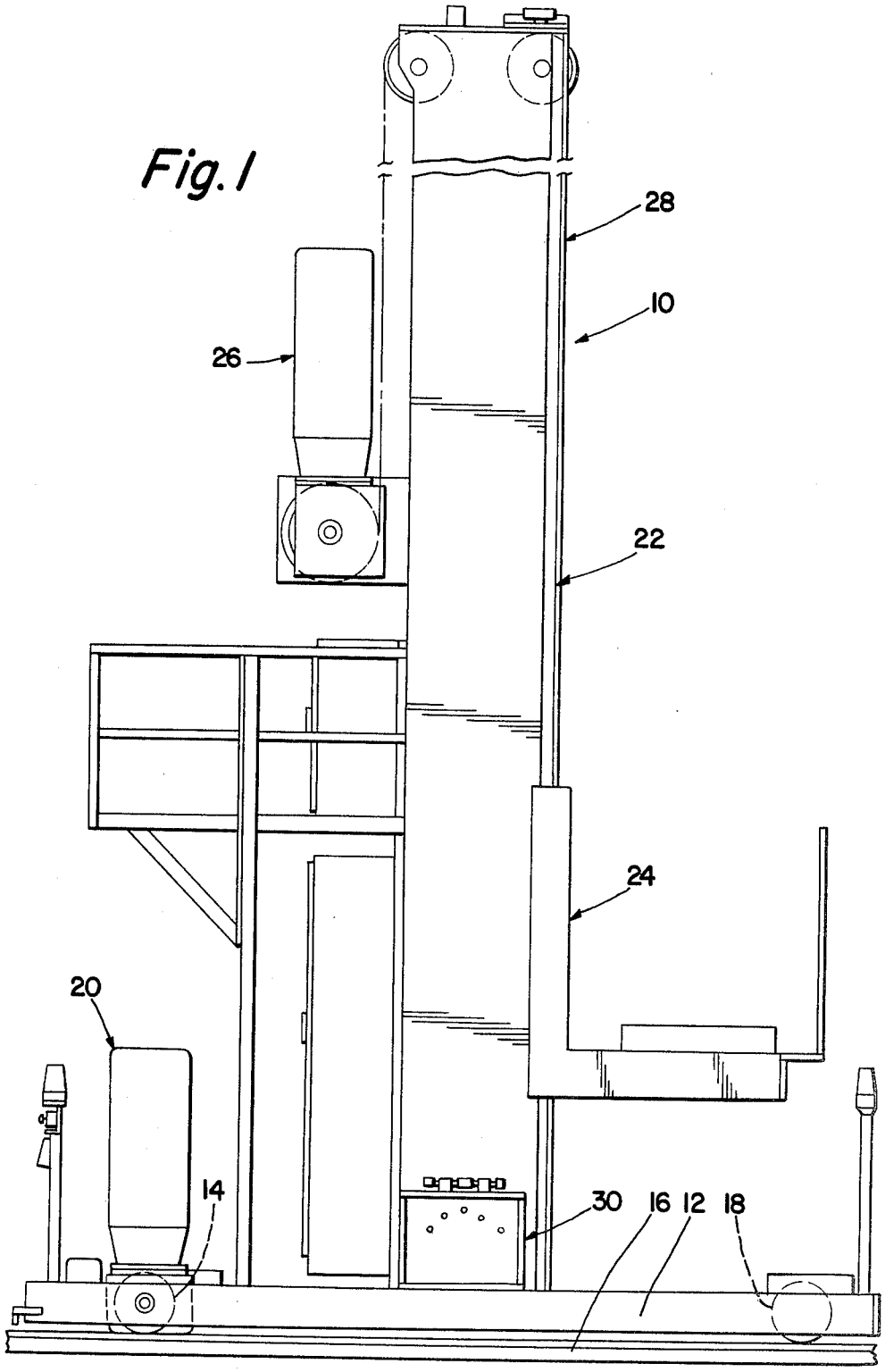
FIG. 1 is a side elevation view of a storage/retrieval machine constructed in accordance with the invention.

Referring to FIG. 1, there is illustrated a storage/retrieval or S/R machine 10 comprising a base frame 12, one or more drive wheels 14 mounted for rotation on the frame 12 and engageable with floor mounted rails 16, one or more non-driven wheels 18 mounted for rotation on the frame 12 and engageable with the rails 16, a horizontal drive motor assembly 20 mounted on the frame and operatively connected to the drive wheels to drive the S/R machine horizontally along the rails, a mast assembly 22 mounted to the frame 12, a load carriage assembly 24 attached to the mast assembly for vertical movement relative thereto, and a vertical drive motor assembly 26 attached to the mast assembly 22 and operable to drive the load carriage 24 up and down the mast by means of a cable or chain system 28.

Figure 2:
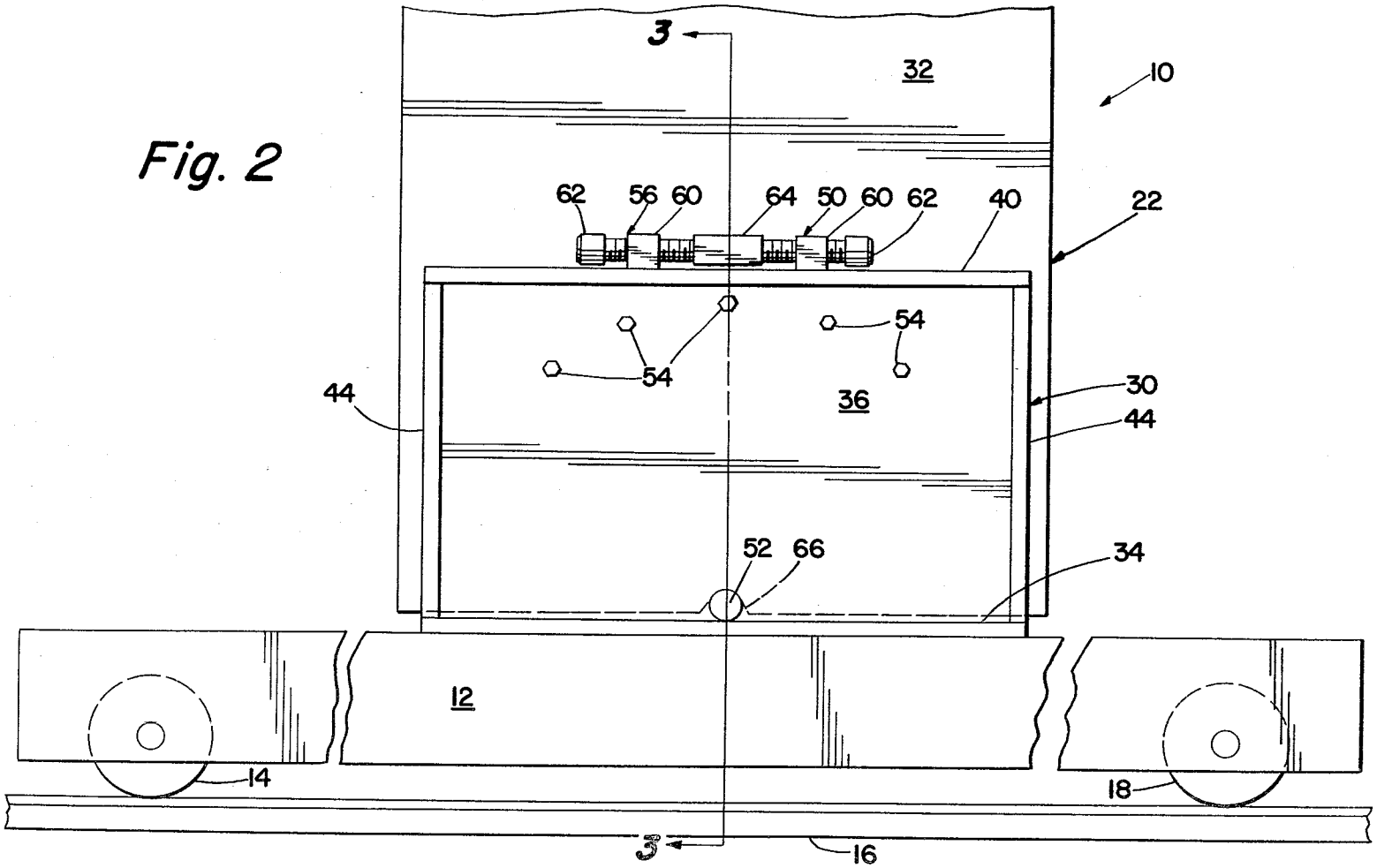
FIG. 2 is an enlarged fragmentary side elevation view of a portion of the machine shown in FIG. 1.
Figure 3:
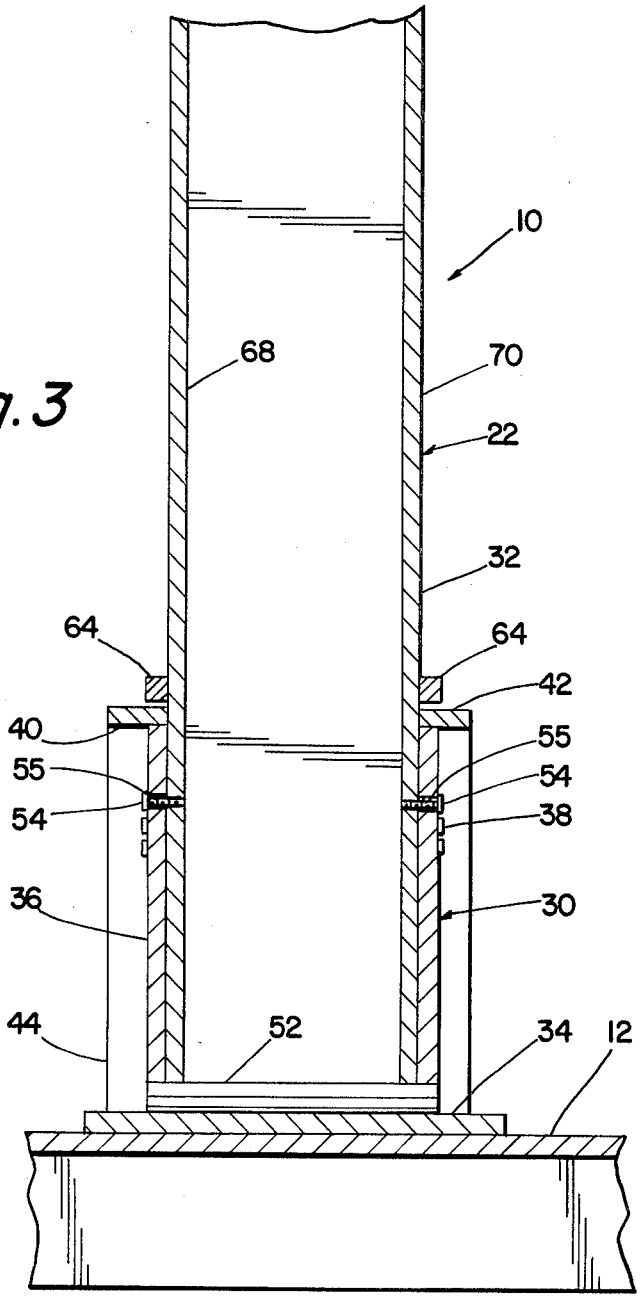
FIG. 3 is a section view taken along line 3—3 of FIG. 2.

Referring particularly to FIGS. 2 and 3, in accordance with the invention, the mast assembly 22 comprises a fabricated saddle structure 30 which is bolted or otherwise fastened to the frame 12, and a mast member 32, which is recieved within the saddle structure and attached thereto.

The saddle structure 30 comprises a base member 34 which is attached to the machine frame; a first vertical side plate 36 welded to the base plate 34; a second vertical side plate 38 spaced transversely of the first relative to the S/R machine and welded to the base plate 34; first and second top plates 40 and 42 welded to the tops of the side plates 36 and 38 respectively; front and rear end plates 44 welded to the side plates 36 and 38, top plates 40 and 42, and base plate 34; a horizontal pivot member 52 received through the side plates 36 and 38 and welded or otherwise fastened thereto; a plurality of clamp bolts 54 received through clearance holes 55 in the side plates 36 and 38 and threaded into side plates 68 and 70 of the mast member 32; and first and second adjustment assemblies 56 and 58 attached to each of the top plates 40 and 42. The adjustment assemblies 56 and 58 each comprise a bracket member 60 welded to the top plate 40, and a screw 62 threaded through the bracket member. The adjustment assemblies are spaced apart about a vertical centerline through the side plates 36 and 38, and the assemblies are positioned so that the ends of the screws 62 bear against opposite ends of bosses 64 welded to the side plates 68 and 70.

Substantially V-shaped notches 66 are formed centrally in the bottom of [each of] the side plates 68 and 70 and are received over the pivot member 52 when the mast is assembled to the frame.

When an S/R machine 10 is delivered to a job site, the mast and frame assemblies are shipped separately. With the rails 16 in place and leveled on a warehouse floor, the frame 12 supported on wheels 14 and 18 in position on the tracks, and the saddle structure 30 mounted on the base 12, the mast member 32 is positioned, by means of a crane or the like, within the saddle structure 30 and with the notches 66 received over the pivot member 52. The mast member is then roughly aligned vertically and the clamp bolts 54 are threaded into the mast side plates 68 and 70 to clamp the saddle plates between the mast and the heads of bolts 54 just enough to hold the mast temporarily in position.

Using a plumb line or other known means for establishing vertical alignment as a reference, the mast member is pivoted about the pivot member 52 by threading one or the other of adjusting screws 62 against the boss 64, while the remaining screw is backed off accordingly, the clearance holes 55 allowing sufficient movement of the mast relative to the saddle to effect precise alignment. When the mast member is precisely aligned vertically, the clamp bolts 54 are tightened fully into the mast side plates to hold the mast in position relative to the saddle.

At this point, the S/R machine can be moved to various address locations (not shown) in the warehouse to verify the alignment. If more precise alignment is required, the clamp bolts 54 can be backed off slightly and the plumbing process repeated at any position along the rails 16, after which the clamp bolts are again tightened into the mast.

After final plumbing is completed, the mast side plates 68 and 70 are welded to the saddle structure to permanently position the mast assembly relative to the frame.

In the illustrative embodiment the clamp bolts 54 are distributed in an arc about the axis of the pivot member 52 to facilitate movement of the bolts 54 within the clearance holes 55 when the mast position is adjusted about the pivot. It has been found in practice that using clearance holes of a diameter of ⅛ inch greater than the diameter of the bolts, sufficient movement can be obtained even if the bolts 54 are aligned horizontally across the saddle plates.

Figure 4:
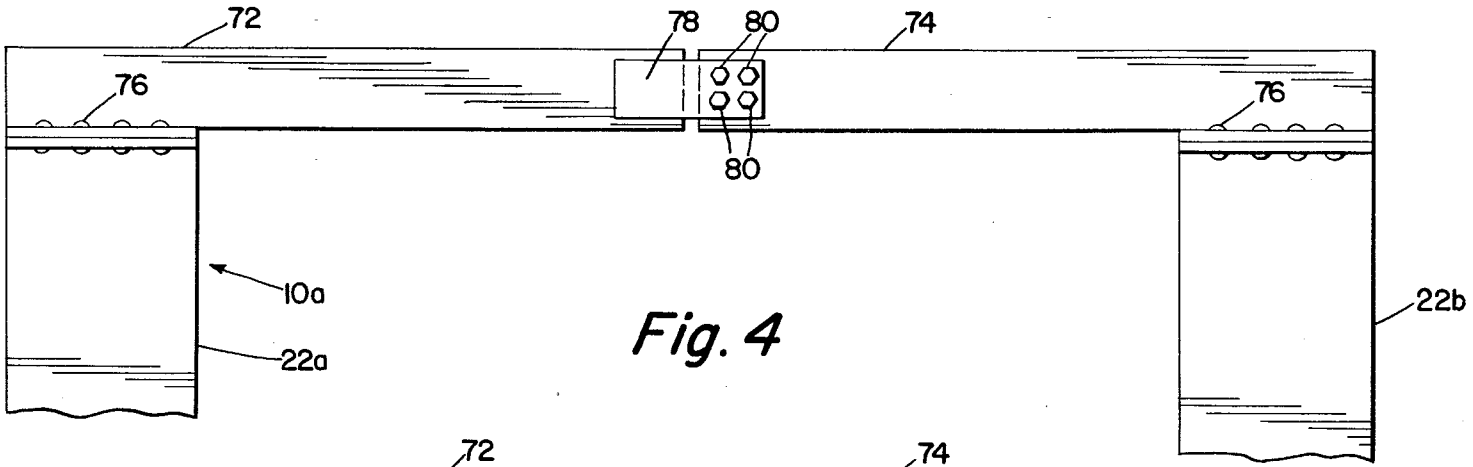
FIG. 4 is a fragmentary side elevation view of a further aspect of the invention applied to a double masted storage/retrieval machine.
Figure 5:
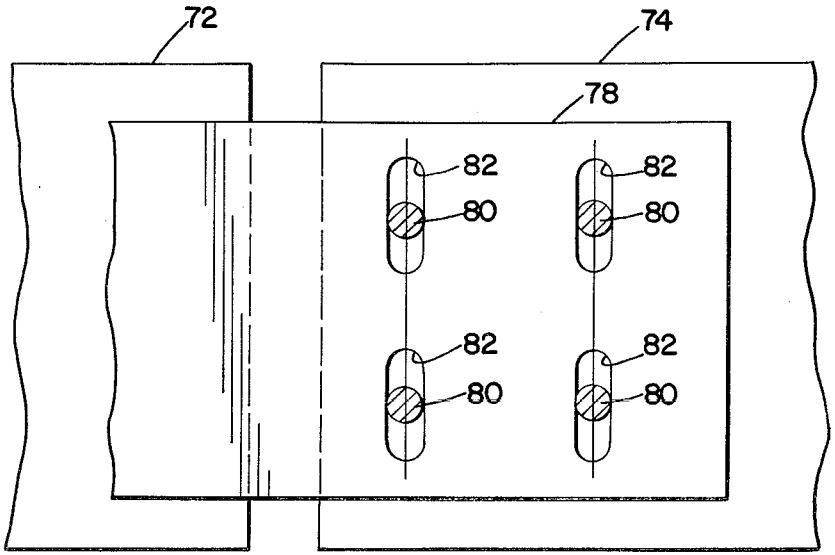
FIG. 5 is an enlarged view of a portion of the structure shown in FIG. 4.

In FIGS. 4 and 5 there is illustrated somewhat schematically a further aspect of the invention as it is applied to a double masted S/R machine.

The double masted machine, designated by the reference numberal 10*a*, comprises first and second mast assemblies 22*a* and 22*b* which are identical to the mast assembly 22 in their attachment to a frame, each including essentially identical mast members 32 and saddle structures 30. The mast assemblies 22*a* and 22*b* are joined by means of first and second mast cap members 72 and 74 which are attached to the tops of the mast assemblies as by bolts 76, and which are fastened together by means of a plate 78 which is welded to one of the mast cap members and bolted to the other mast cap member by means of bolts 80.

In FIG. 5 there is shown an enlarged view of the right hand portion of the plate 78 and its attachment to mast cap member 74, with the bolts 80 shown in section for clarity. In order to allow each mast assembly to be separately aligned, the bolts 80 are received in slots 82 formed in the plate 78.

To align the double masted machine illustrated by FIG. 4, the bolts 80 are loosely received in the slots 82 while each of the mast assemblies is aligned independently by the method discussed above. After each mast is aligned and fixed to its saddle structure, the bolts 80 are tightened to fix the mast assemblies together through the mast cap members 72 and 74.

I claim:

1. In a storage/retrieval machine comprising a frame and a mast assembly attached to said frame and extending vertically therefrom; the improvement wherein said mast assembly comprises an upstanding support structure attached to said frame, said support structure including first and second spaced walls upstanding from said frame, and pivot pin means received in a lower portion of said first and second walls; a mast including at least one plate member received between said first and second walls in face-to-face contact therewith and having an essentially V-shaped notch formed in the lower edge thereof engageable with said pivot pin means; clamp means acting on at least one of said first and second walls of an upper portion thereof and on said at least one plate member to apply a clamping force therebetween, said clamp means comprising at least one threaded fastener received through a clearance hole formed in said wall and threaded into said plate member with a head formed on said fastener in engagement with said wall; and adjustable means acting between at least one of said first or second walls and said at least one plate member for pivotally moving said mast about said pivot pin means against said clamping force.

2. Apparatus as claimed in claim 1 in which said mast member comprises first and second plate members each in face-to-face contact with one of said first and second walls, and including a plurality of said threaded fasteners received through both of said first and second walls and threaded into said first and second plate members.

3. Apparatus as claimed in claim 2, in which said fasteners are arranged in arcs described about the axis of said first pivot means.

4. Apparatus as claimed in claim 1, in which said adjustable means comprises first and second internally threaded members attached to said support structure and spaced apart along the longitudinal axis of said storage/retrieval machine, first and second externally threaded members threaded through said internally threaded members in opposed relation to one another, and means engageable by said first and second externally threaded members attached to said at least one plate member.

5. Apparatus as claimed in claim 4, including first and second mast assemblies attached to said frame and extending vertically therefrom, each of said mast assemblies including said support structure, said mast member, said clamp means, and said adjustable means; a first connecting member attached to said first mast assembly and extending toward said second mast assembly; a second connecting member attached to said second mast member and extending toward said first mast assembly; and connecting plate means fixed to one of said first or second connecting members and adjustably attached to the other of said first or second connecting members.

6. Apparatus as claimed in claim 5, in which said connecting plate means includes one or more vertical slots formed therein, said connecting plate means being attached to said other of said first or second connecting members by one or more bolts received through said one or more vertical slots.

* * * * *